US009131823B2

(12) United States Patent
Maczuzak

(10) Patent No.: US 9,131,823 B2
(45) Date of Patent: Sep. 15, 2015

(54) HI/LO VOLUME SPRAY ADJUSTMENT FOR MOP HANDLE

(71) Applicant: EVERCARE COMPANY, Alpharetta, GA (US)

(72) Inventor: Michael J. Maczuzak, Bratenahl, OH (US)

(73) Assignee: Butler Home Products, LLC, Marlborough, MA (US)

( * ) Notice: Subject to any disclaimer, the term of this patent is extended or adjusted under 35 U.S.C. 154(b) by 516 days.

(21) Appl. No.: 13/651,072

(22) Filed: Oct. 12, 2012

(65) Prior Publication Data

US 2014/0101877 A1 Apr. 17, 2014

(51) Int. Cl.
*A47L 13/22* (2006.01)
*A47L 13/26* (2006.01)

(52) U.S. Cl.
CPC . *A47L 13/22* (2013.01); *A47L 13/26* (2013.01)

(58) Field of Classification Search
CPC ..... A47L 13/22; A47L 13/26; A47L 13/42; A47L 11/4075
USPC ..... 401/139, 140, 188 R, 190; 222/174, 222/470, 472–474; 239/526–528, 532
See application file for complete search history.

(56) References Cited

U.S. PATENT DOCUMENTS

| | | | | | |
|---|---|---|---|---|---|
| 1,199,646 | A * | 9/1916 | Witherly | ..... | 401/140 |
| 2,262,334 | A * | 11/1941 | Rugaard | ..... | 401/139 |
| 4,432,472 | A | 2/1984 | Lamm | | |
| 5,368,202 | A | 11/1994 | Smrt | | |
| 5,518,148 | A * | 5/1996 | Smrt | ..... | 222/174 |
| 5,597,497 | A * | 1/1997 | Dean et al. | ..... | 222/473 |
| 5,769,279 | A * | 6/1998 | Smrt | ..... | 222/174 |
| 6,497,525 | B1 * | 12/2002 | Huang | ..... | 401/138 |
| 6,960,042 | B1 * | 11/2005 | Hsiao | ..... | 401/138 |
| 6,976,644 | B2 | 12/2005 | Troudt | | |
| 7,040,510 | B1 | 5/2006 | Hester | | |
| 7,661,609 | B2 * | 2/2010 | Dexter et al. | ..... | 239/527 |
| 2003/0053845 | A1 * | 3/2003 | Aberegg et al. | ..... | 401/138 |
| 2004/0046628 | A1 * | 3/2004 | Hofte et al. | ..... | 336/115 |
| 2004/0141798 | A1 * | 7/2004 | Garabedian et al. | ..... | 401/279 |
| 2005/0058500 | A1 * | 3/2005 | Hall et al. | ..... | 401/140 |
| 2006/0222441 | A1 * | 10/2006 | Tanaka et al. | ..... | 401/139 |
| 2012/0137465 | A1 * | 6/2012 | Nolan et al. | ..... | 15/321 |
| 2012/0227763 | A1 * | 9/2012 | Hayes et al. | ..... | 401/139 |
| 2012/0325934 | A1 * | 12/2012 | DeLorme et al. | ..... | 239/526 |
| 2014/0103142 | A1 * | 4/2014 | Butts | ..... | 239/302 |

* cited by examiner

*Primary Examiner* — David Walczak
*Assistant Examiner* — Bradley Oliver
(74) *Attorney, Agent, or Firm* — McCarter & English, LLP

(57) ABSTRACT

A cleaning device includes a shaft, a cleaning element mounted at a distal end of the shaft, a spray device mounted near the distal end of the shaft, a handle assembly mounted at a proximal end of the shaft, and a rod. The spray device includes a liquid reservoir, a pump and a nozzle. The handle assembly includes a lever rotatable about a pivot point with first and second engagement surfaces of different distances from the pivot point, and a knob having a cam surface and rotatable between first and second positions. The rod extends between the pump and the lever. The knob cam surface is engaged with the rod for aligning a first end of the rod to the first engagement surface with the knob in the first position and aligning the first end of the rod to the second engagement surface with the knob in the second position.

12 Claims, 14 Drawing Sheets

HI/LO VOLUME SPRAY ADJUSTMENT FOR MOP HANDLE

RELATED APPLICATIONS

This application claims the benefit of U.S. Provisional Application No. 61/546,907, filed Oct. 13, 2011, and which is incorporated herein by reference.

FIELD OF THE INVENTION

The present invention relates to a spray mop, and more particularly to a spray mop in which the volume of spray dispensed per activation of the trigger lever can vary.

BACKGROUND OF THE INVENTION

Remotely activated sprayers are known. For example, U.S. Pat. Nos. 4,432,472, 5,368,202, 6,976,644 and 7,040,510 disclose mounting spray devices on one end of a shaft and remotely activating the spray device from the other end of the shaft. The U.S. Pat. No. 4,432,472 patent discloses a buffer at the distal end of the shaft, along with a chain connected thereto that extends to the proximate end of the shaft for operating the spray device remotely. The U.S. Pat. Nos. 5,368,202, 6,976,644 and 7,040,510 patents disclose a trigger lever at the proximal end (i.e. user's handle end) of the shaft, which when activated (moved) by the user causes the spray device at the other end of the pole to emit a liquid spray. The use of such trigger levers to remotely trigger a spray device at the other end of the shaft which also contains a cleaning device such as a broom or mop is also known (i.e. spray mop).

One issue with conventional spray mops is the user's need to control the amount of spray emitted by the spray device each time the lever is activated. Spray volume adjustments made down at the spray device are not ideal because it requires the user to bend down and make such adjustments at the distal end of the shaft. Another issue is that different applications require different spray patterns. Yet, conventional spray mops fail to provide a reliable, inexpensive configuration for modifying the spray pattern.

There is a need for a convenient adjustment mechanism at the proximal (user) end of the spray mop shaft for adjusting the amount of liquid that is released for each operation of the lever. Ideally, such an adjustment mechanism will not limit the travel of the spray lever to accomplish the adjustment of liquid spray amount, so that the user will experience the same action of the lever no matter how much liquid is being dispensed by the spray device. There is also a need for a reliable and inexpensive configuration for allowing the user to modify the spray pattern.

BRIEF SUMMARY OF THE INVENTION

The aforementioned problems and needs are addressed by a cleaning device that includes a shaft having a proximal end and a distal end, a cleaning element mounted at the distal end of the shaft, a spray device mounted at or near the distal end of the shaft, a handle assembly mounted at the proximal end of the shaft, and a rod. The spray device includes a reservoir for storing liquid, a pump in fluid communication with the reservoir, and a nozzle in fluid communication with the pump. The handle assembly includes a lever rotatable about a pivot point with the lever having first and second engagement surfaces of different distances from the pivot point, and a knob having a cam surface and being rotatable between first and second positions. The rod extends between the pump and the lever. The knob cam surface is engaged with the rod for aligning a first end of the rod to the first engagement surface with the knob in the first position and aligning the first end of the rod to the second engagement surface with the knob in the second position. Rotation of the lever causes the rod to longitudinally move toward the pump.

In another aspect of the present invention, a cleaning device includes a shaft having a proximal end and a distal end, a cleaning element mounted at the distal end of the shaft, a spray device mounted at or near the distal end of the shaft, a handle assembly mounted at the proximal end of the shaft, and a rod. The spray device includes a reservoir for storing liquid, a pump in fluid communication with the reservoir, and a nozzle in fluid communication with the pump. The handle assembly includes a lever rotatable about a pivot point with the lever having first and second engagement surfaces of different distances from the pivot point, and a knob having a cam surface and being rotatable between first and second positions. The rod has a first end terminating at the pump and a second end terminating at the lever. The knob cam surface is engaged with a side surface of the rod for translating the rod second end for engagement with the first engagement surface with the knob in the first position and for engagement with the second engagement surface with the knob in the second position. Rotation of the lever causes the rod to longitudinally move toward and activate the pump.

Other objects and features of the present invention will become apparent by a review of the specification, claims and appended figures.

DETAILED DESCRIPTION OF THE INVENTION

Figure 1:
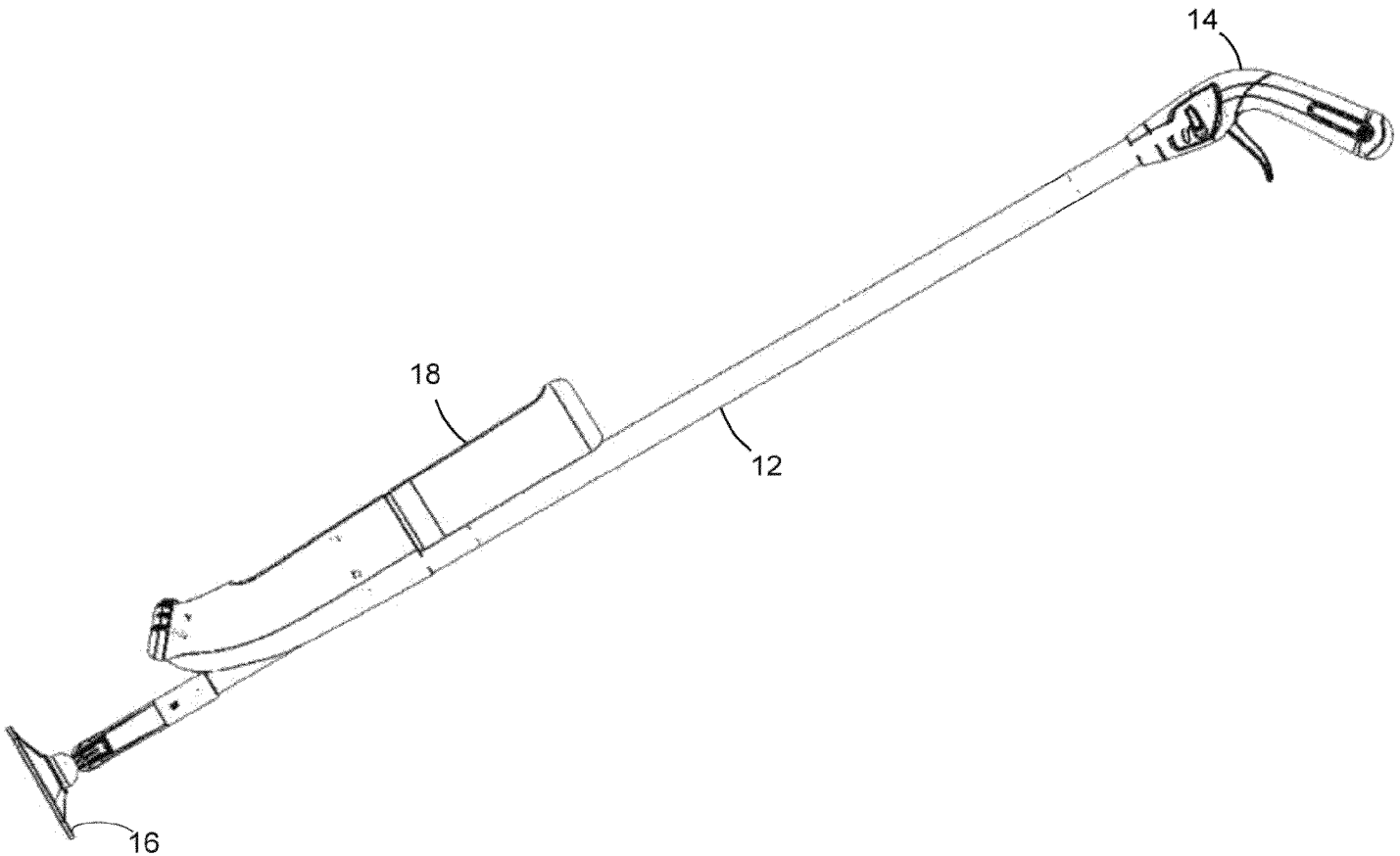
FIG. 1 is a side view of the spray mop.

The present invention is a spray mop, as shown in FIG. 1. The spray mop includes a shaft 12 terminating at a proximal end with a handle assembly 14 and at a distal end with a cleaning element 16. A spray device assembly 18 is mounted to the shaft 12 closer to the distal end of shaft 12.

Figures 2A, 2B:
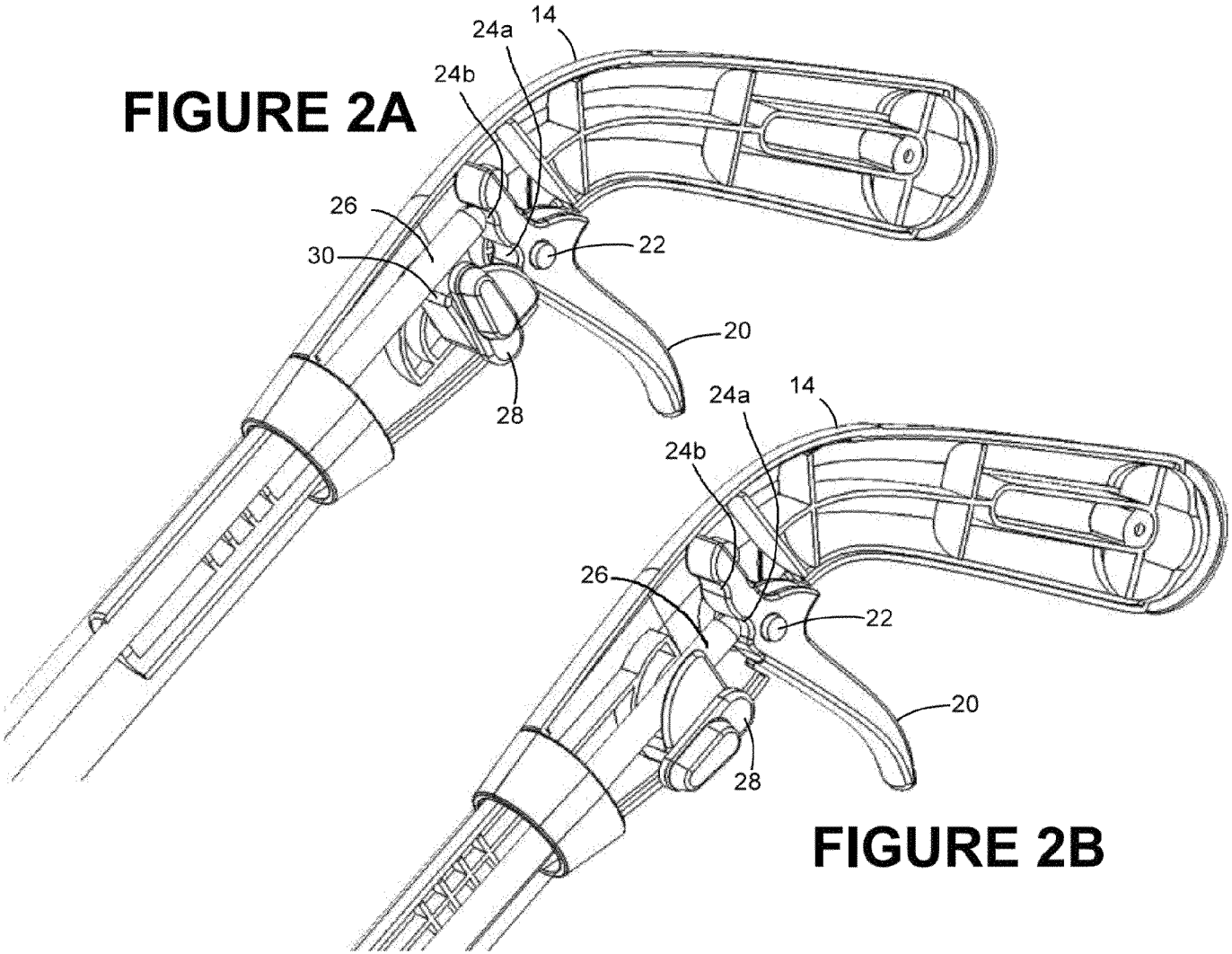
FIG. 2A is a perspective view of the interior of the handle assembly, with the rod positioned on the engagement surface for high volume spray.
FIG. 2B is a perspective view of the interior of the handle assembly, with the rod positioned on the engagement surface for low volume spray.
Figure 3A:
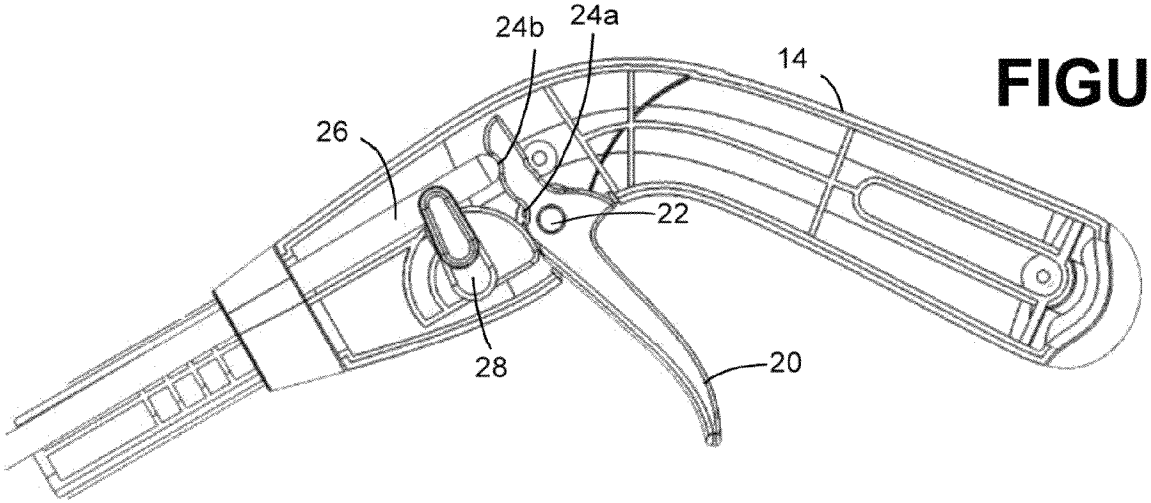
FIG. 3A is a side view of the interior of the handle assembly, with the rod positioned on the engagement surface for high volume spray.
Figure 3B:
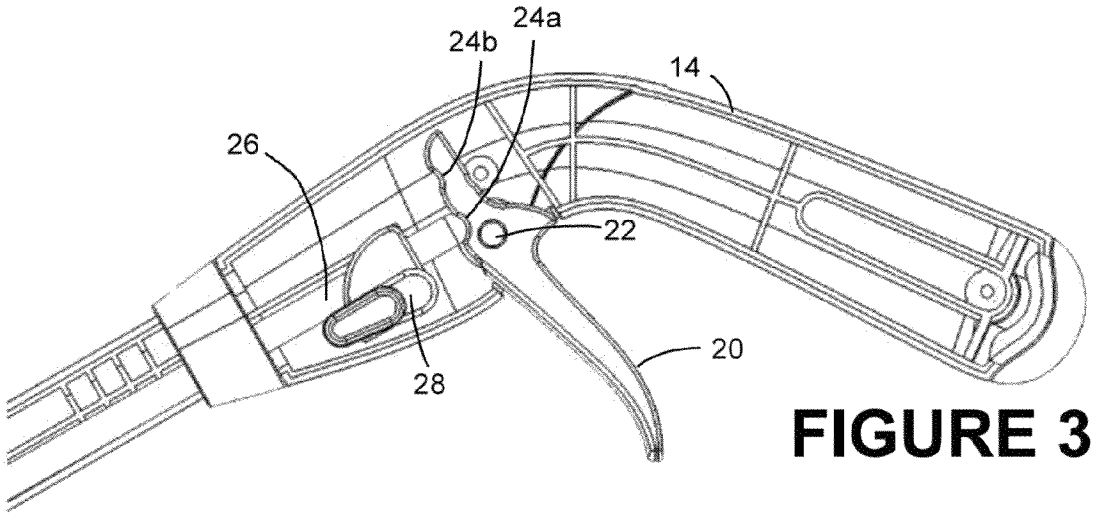
FIG. 3B is a side view of the interior of the handle assembly, with the rod positioned on the engagement surface for low volume spray.
Figure 4A:
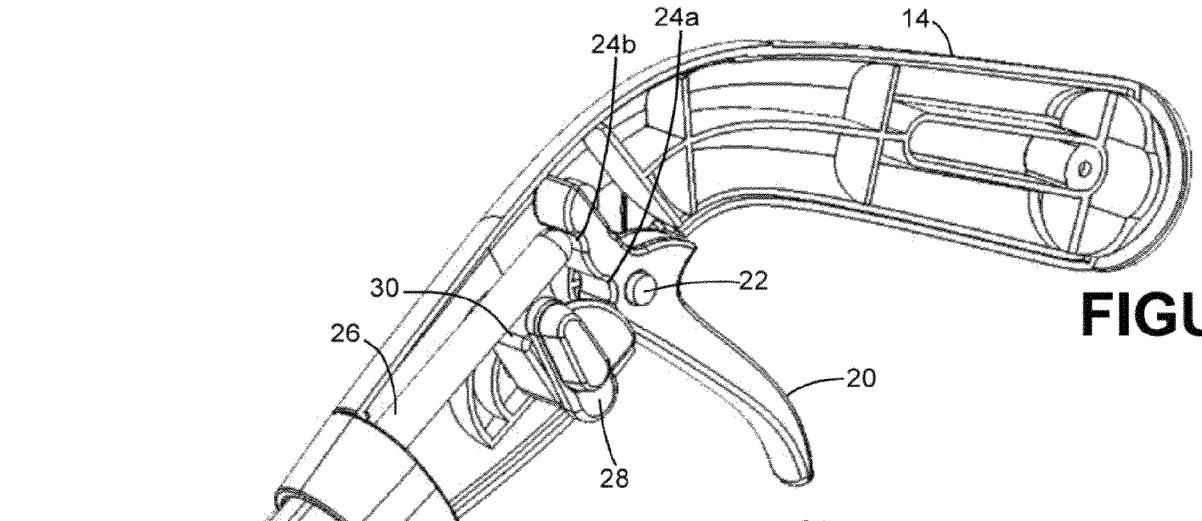
FIG. 4A is a perspective view of the interior of the handle assembly, with the rod positioned on the engagement surface for high volume spray.
Figure 4B:
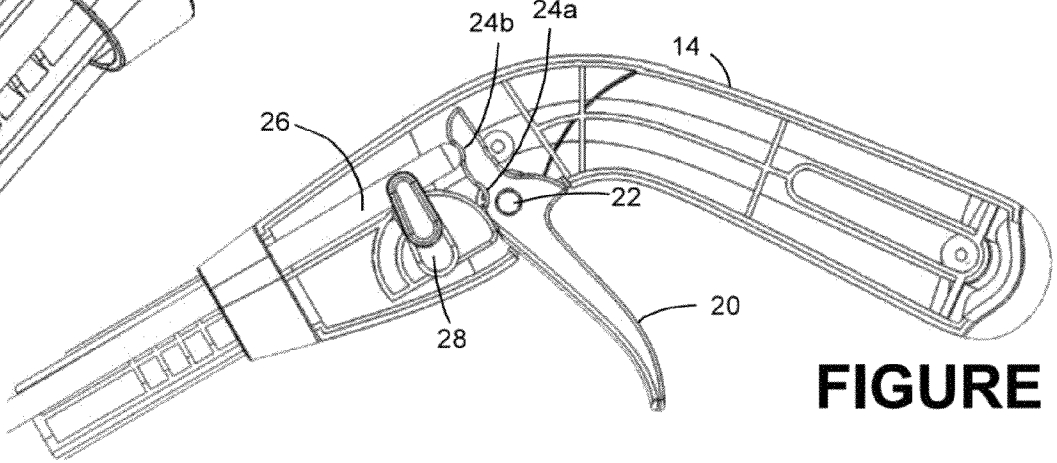
FIG. 4B is a side view of the interior of the handle assembly, with the rod positioned on the engagement surface for high volume spray.
Figure 5A:
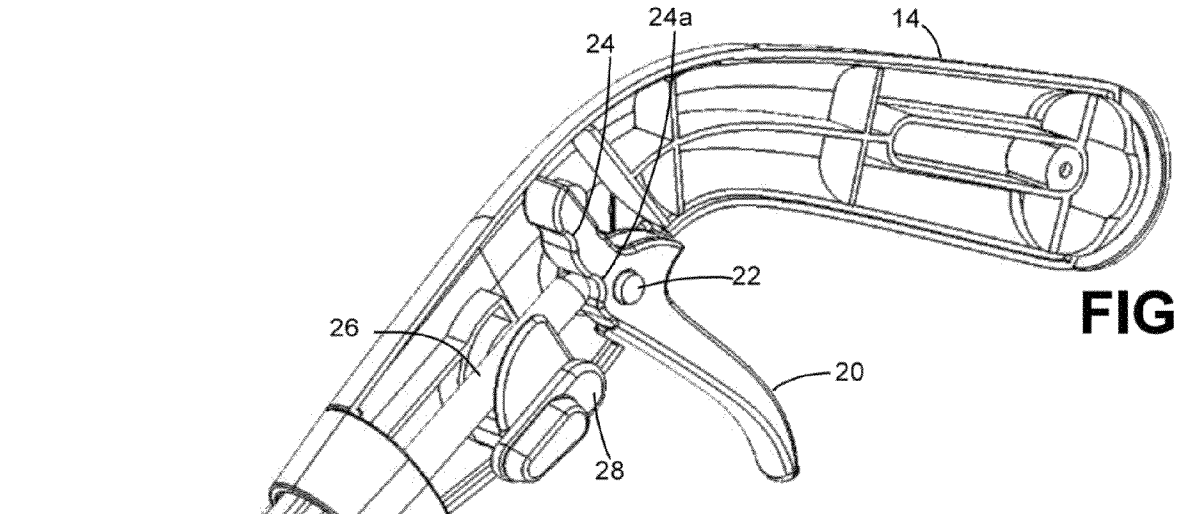
FIG. 5A is a perspective view of the interior of the handle assembly, with the rod positioned on the engagement surface for low volume spray.
Figure 5B:
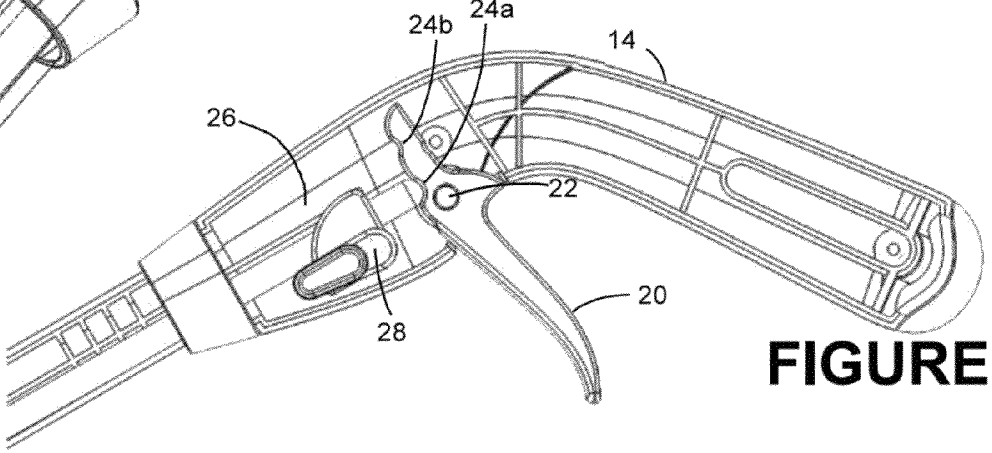
FIG. 5B is a side view of the interior of the handle assembly, with the rod positioned on the engagement surface for low volume spray.

The handle assembly 14 include a lever 20 that is rotatable (i.e. by a user) about a pivot point 22, as best illustrated in FIGS. 2A and 2B. The lever 20 includes multiple concave engagement surfaces 24 (two such surfaces 24*a* and 24*b* illustrated in the figures). A rod 26 is slidably mounted in shaft 12, and selectively engages with engagement surfaces 24*a*/24*b*. When the user rotates lever 20, the lever 20 pushes on rod 26, causing rod 26 to slide toward the distal end of shaft 12 (to operate the spray device assembly as described below).

The handle assembly 14 includes a mode control knob 28 that dictates the amount of longitudinal movement the rod 26 experiences as the user rotates lever 20 through its full range of motion (and thus dictates the volume of liquid sprayed during a single operation of the lever). Specifically, the mode control knob 28 controls the position of engagement of the rod 26 on the lever 20 (i.e. which concave engagement surface 24*a*/24*b* is engaged with rod 26). The mode control knob 28 has a cam surface 30 that engages with the side surface of rod 26. When the control knob 28 is rotated, the cam surface transversely moves the proximal end of rod 26 between engagement surface 24*a* and engagement surface 24*b*. With the mode control knob 28 rotated to its low spray volume position (see FIGS. 2B, 3B, 5A, 5B), the proximal end of the rod 26 is positioned on engagement surface 24*a*, which is closer to pivot point 22 and thus results in a smaller longitudinal displacement of the rod 26 (for a smaller volume of spray) as the lever 20 is moved through its range of motion. With the mode control knob 28 rotated to its high spray volume position (see FIGS. 2A, 3A, 4A, 4B), the proximal end of the rod 26 is positioned on the engagement surface 24*b*, which is further away from pivot point 22 and thus results in a greater longitudinal displacement of the rod 26 (for a greater volume of spray) as the lever 20 is moved through the same range of motion.

Figure 6:
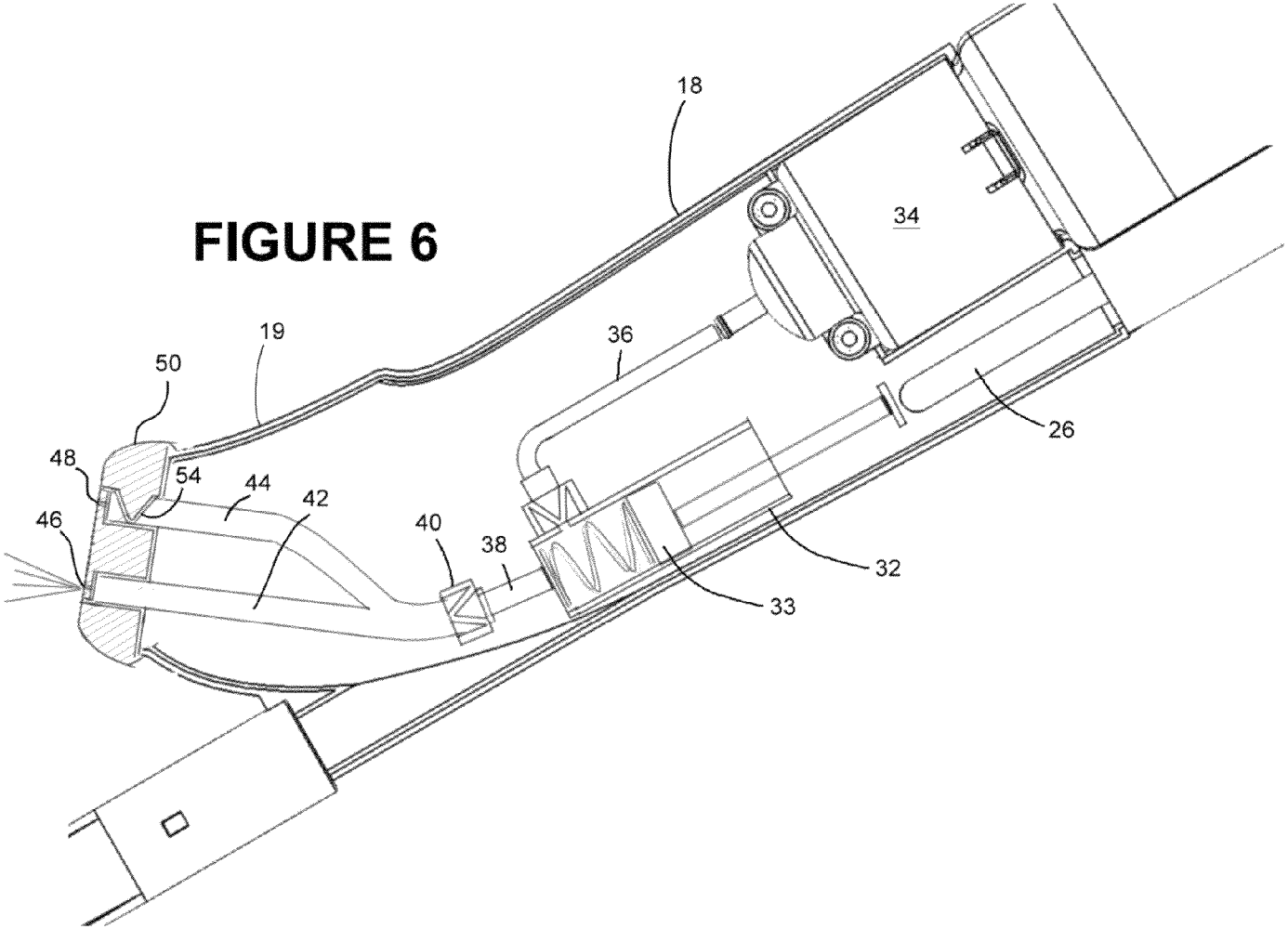
FIG. 6 is a side view of the interior of the spray device assembly.

The distal end of rod 26 is aligned to and operates a pump 32 as it is longitudinally moved by lever 20, as shown in FIG. 6. Pump 32 includes a plunger 33 that, when compressed by the longitudinal movement of rod 26, draws liquid from a reservoir 34 via intake tube 36, and discharges the liquid into output tube 38. The amount of liquid discharged is a function of the displacement of the pump plunger (and therefore a function of the movement of rod 26). The discharged liquid is delivered to discharge jets as described below that spray liquid from assembly 18 and to the area being cleaned.

The liquid is consistently and continually discharged by pump 18 (and therefore consistently and continually sprayed from assembly 18) throughout the entire travel of the lever 20. However, the volume of liquid discharged and sprayed through that single activation of the lever 20 can be varied by operating the mode control knob 28 without changing the fact that liquid is being continuously sprayed (i.e. the amount of lever arm travel need not be changed, just the rate/volume of liquid being sprayed during the travel). Additionally, the amount of spray volume can be adjusted at the handle assembly 14, instead of down at the sprayer device assembly, which is convenient for the user. While the preferred embodiment includes two positions of the rod engagement on the handle lever as dictated by the mode control knob (i.e. two concave engagement surfaces 24*a*/24*b*), there could be more than two positions if desired.

As illustrated in FIG. 6, a one-way valve 40 is disposed along output tube 38. Output tube 38 then divides into or is coupled to two separate supply tubes 42 and 44 each made of soft compressible tubing. The supply tubes 42/44 each terminate at a spray nozzle 46 or 48. Spray nozzles 46 and 48 have spray patterns that differ from each other (e.g. narrow stream and horizontally extending spray). While the preferred embodiment has two supply tubes and two nozzles, more than two supply tubes and nozzles can be used.

While both supply tubes 42/44 are pressurized with liquid by the operation of pump 32, the operation of nozzles 46/48 can be selectively blocked. Specifically, a rotatable collar 50 is used to selective pinch and occlude one of the supply tubes 42/44, thereby selecting the other supply line and associated nozzle for use. Therefore, as illustrated in FIG. 6, supply tube 44 is pinched by collar 50, thereby preventing liquid from reaching nozzle 48. With the collar rotational position of FIG. 6, liquid only dispenses from nozzle 46 when pump 32 is operated.

Figure 7:
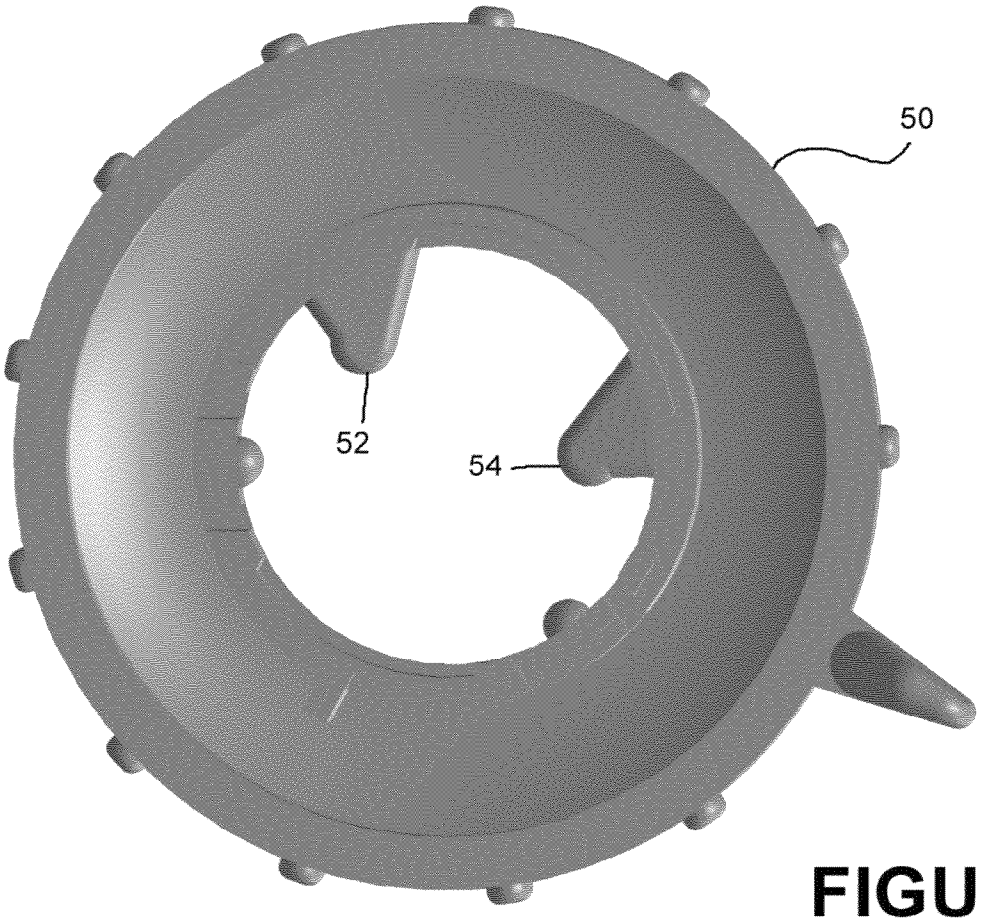
FIG. 7 is a rear view of the rotatable collar.
Figure 8:
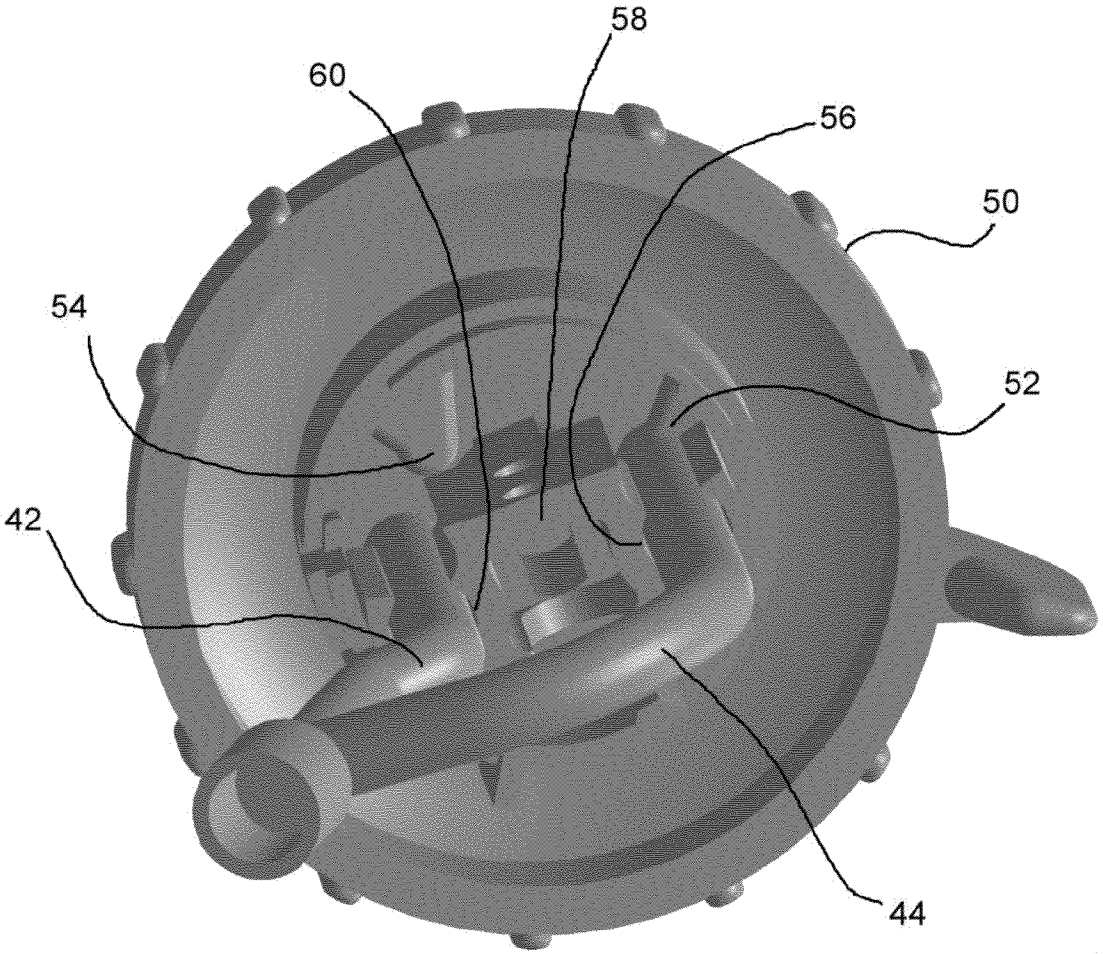
FIG. 8 is a rear view of the rotatable collar, support block and supply tubes.
Figure 9:
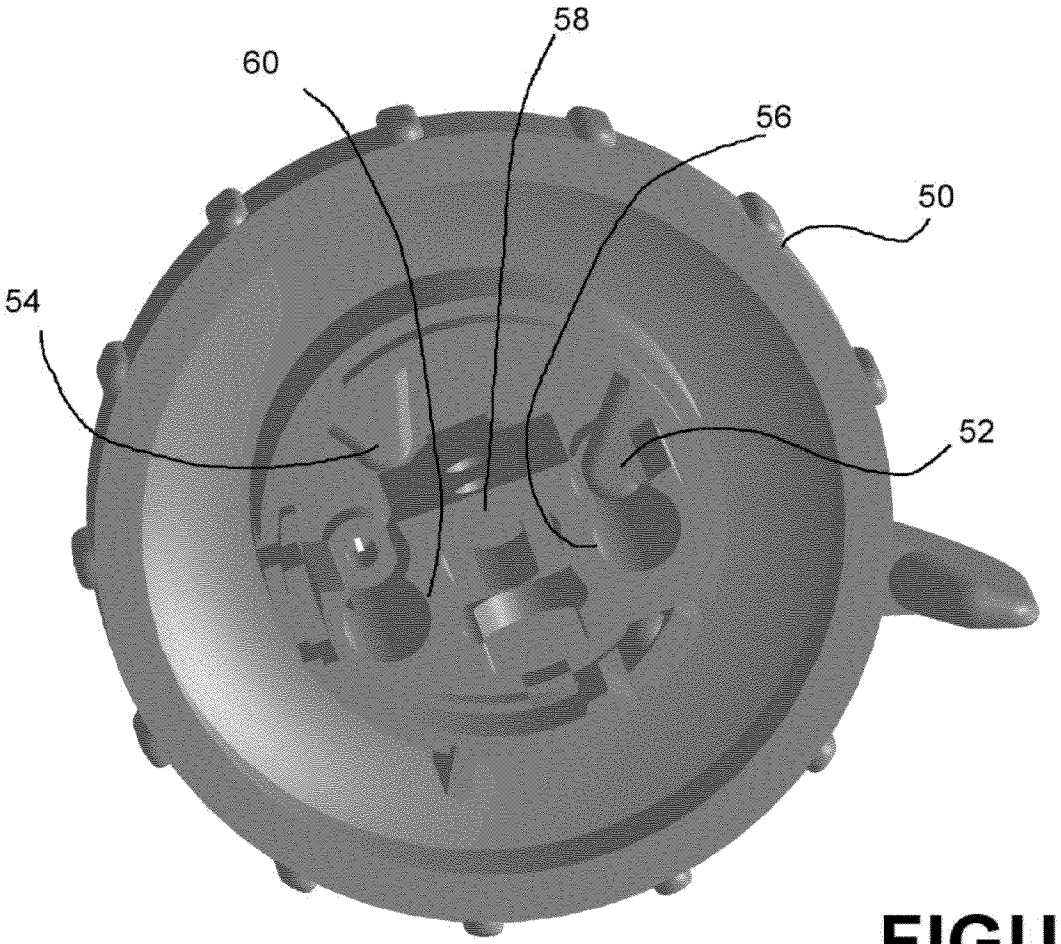
FIG. 9 is a rear view of the rotatable collar and support block.
Figure 10:
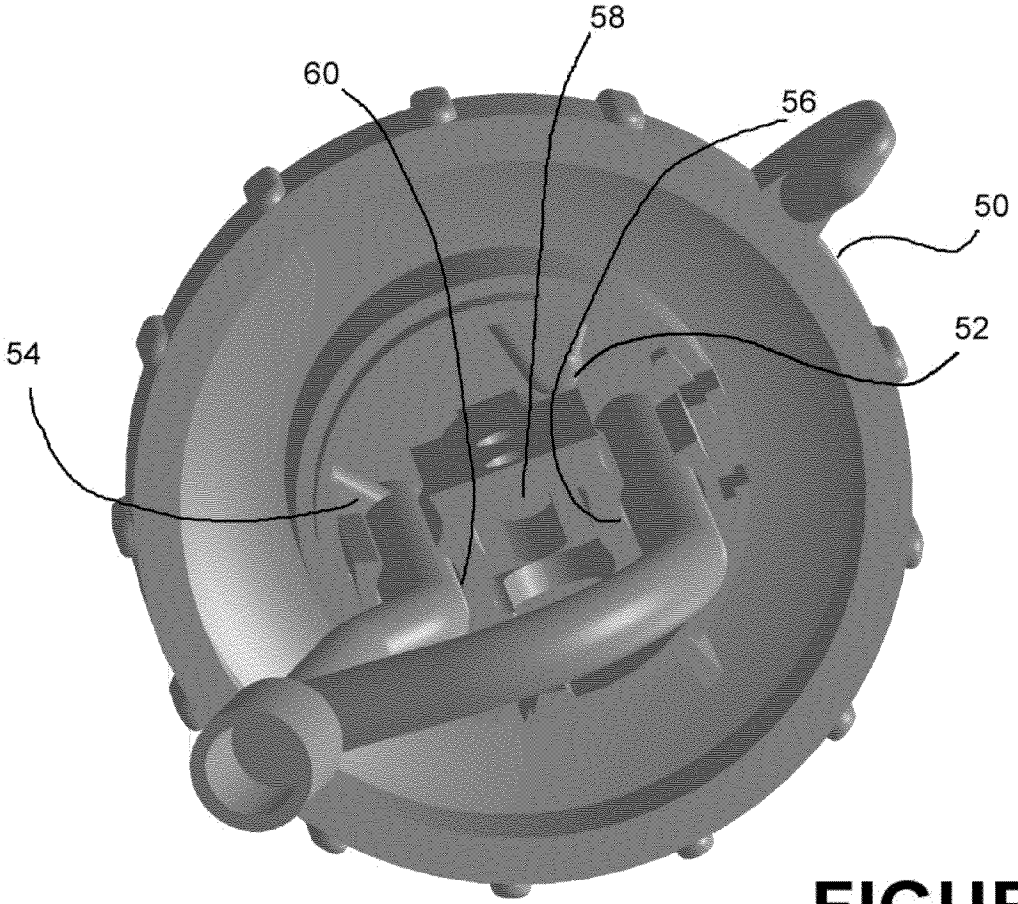
FIG. 10 is a rear view of the rotatable collar, support block and supply tubes.
Figure 11:
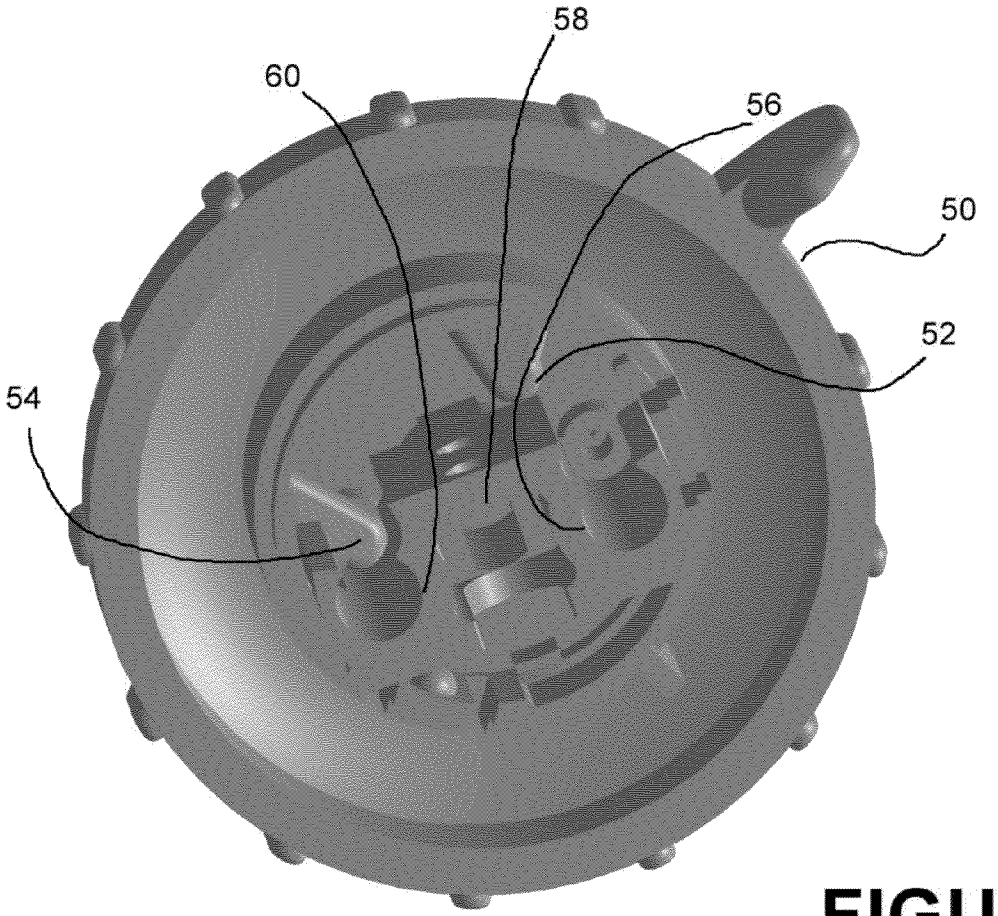
FIG. 11 is a rear view of the rotatable collar and support block.

The collar 50 is best illustrated in FIG. 7. It contains two inwardly facing tube compression protrusions 52 and 54, which selectively pinch closed the supply tubes 42/44. In FIGS. 8 and 9, the collar 50 is rotated to a first rotational position so that protrusion 52 pinches closed the supply tube 44 (i.e. against a rounded compression surface 56 of a support block 58 adjacent the supply tube 44). In this first rotation position, the liquid from pump 32 is supplied only to nozzle 46 of supply tube 42. In FIGS. 10 and 11, the collar 50 is rotated to a second rotation position so that protrusion 54 pinches closed the supply tube 42 (i.e. against a rounded compression surface 60 of support block 58 adjacent the supply tube 42). In this second rotation position, the liquid from the pump 32 is supplied only to nozzle 46 of supply tube 44.

Figure 12:
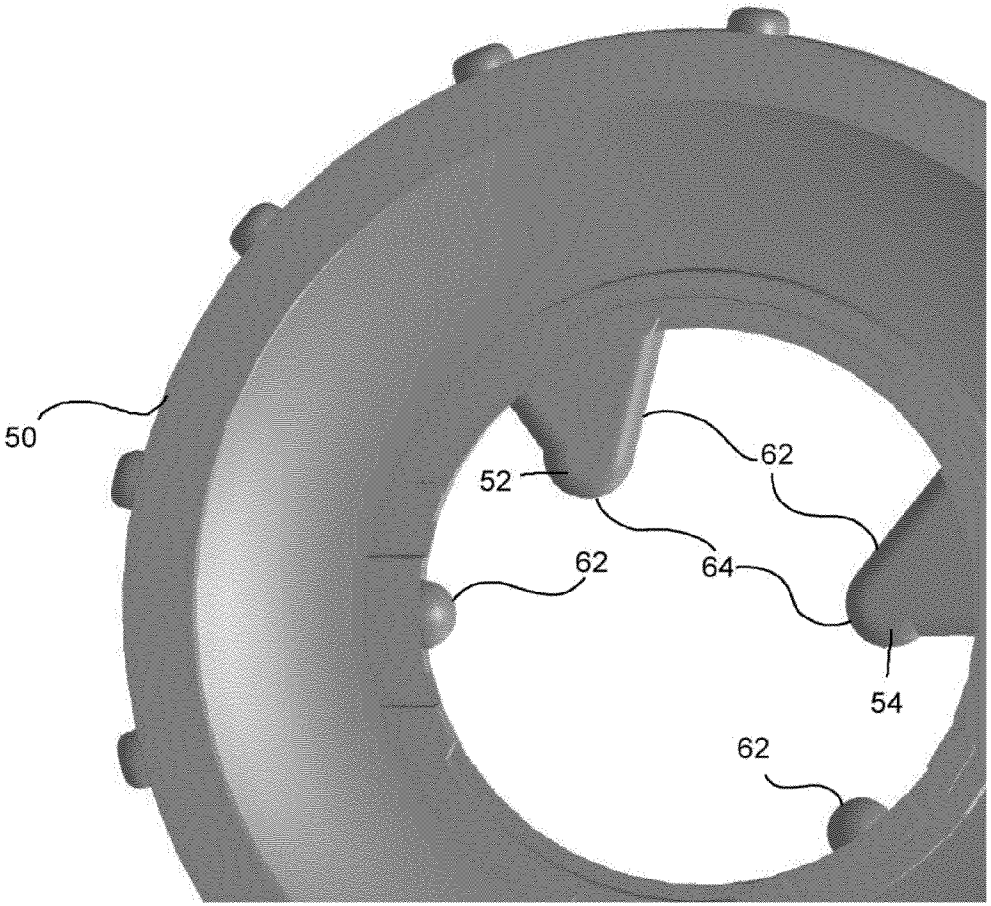
FIG. 12 is a partial rear view of the rotatable collar.

In a preferred embodiment as shown in FIG. 12, each tube compression protrusion 52/54 includes a straight leading edge 62 that terminates in a rounded end 64 (that matches the rounded shape of the corresponding rounded compression surface 56/60 of the support block 58). The rounded end 64 extends out slightly from the leading edge 62 and toward the supply tube 42/44 that it will pinch. It has been discovered that this shape is ideal for effectively pinching and sealing the supply tube 42/44 without dislodging or otherwise damaging the supply tube. Bumps 66 can also extend from the collar as shown in FIG. 12, where the bumps 66 engage complementary notches, holes or channels to provide tactile feedback to the user that the collar 50 is properly positioned to pinch closed the desired supply tube.

Figure 13:
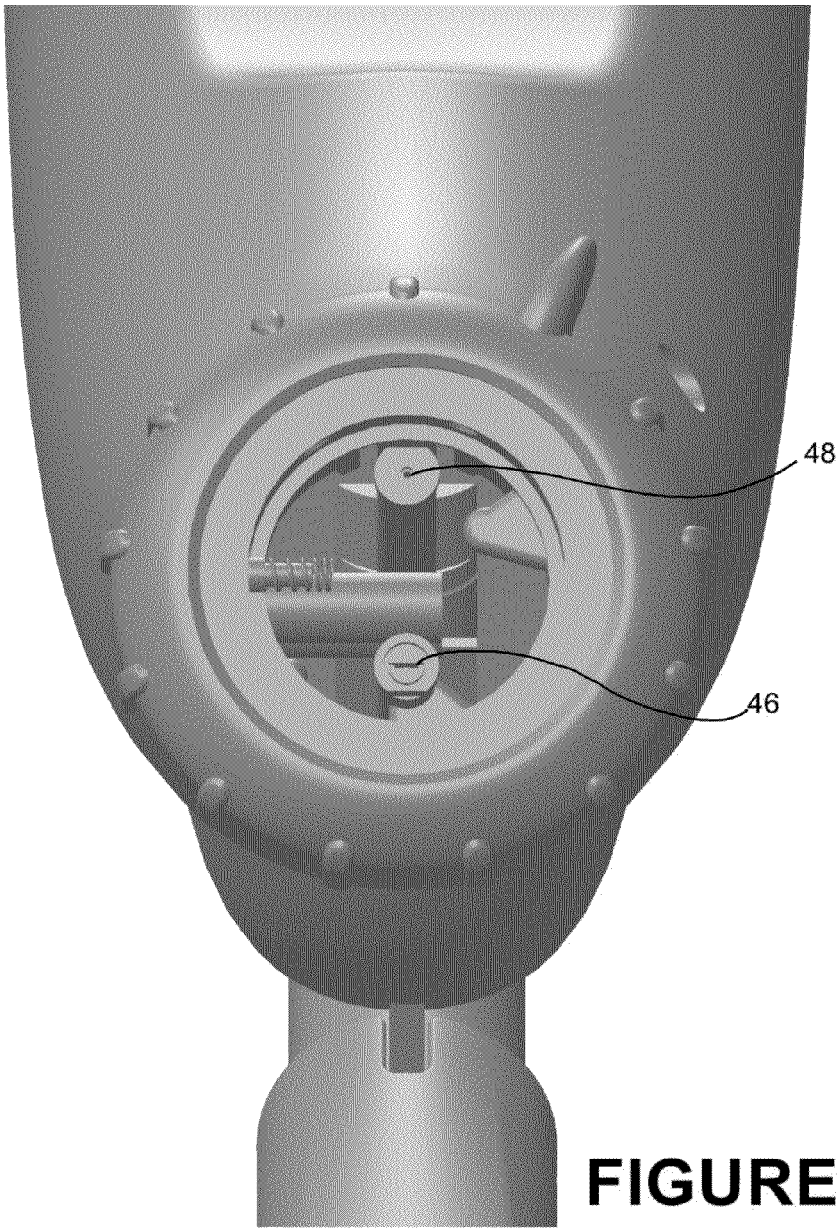
FIGS. 13-14 are front views of the rotatable collar and spray nozzles.
Figure 14:
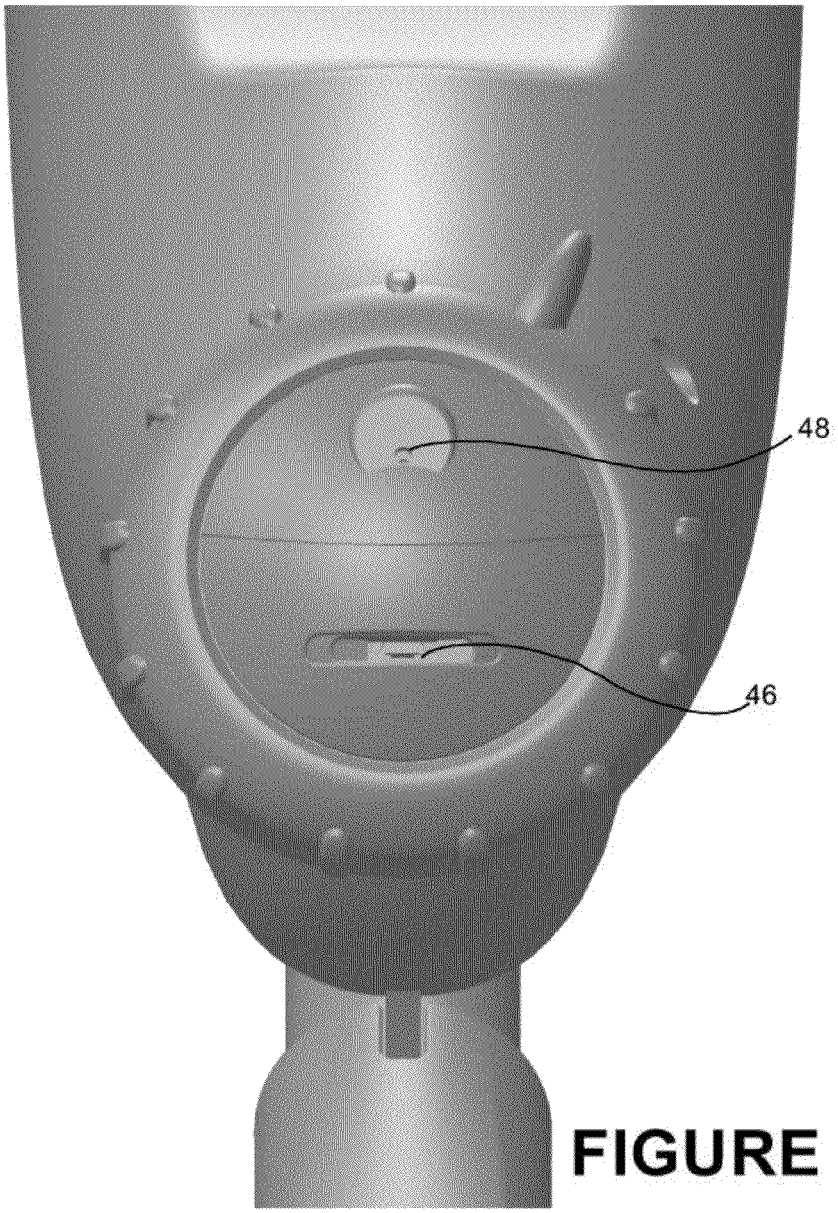

FIGS. 13 and 14 illustrate the two preferred nozzle types. The upper nozzle 48 has a narrow opening for creating a narrow output stream. The lower nozzle 46 has an elongated opening for creating a horizontally elongated output stream. Collar 50 can include a tab 68 extending therefrom to assist the user in rotating the collar 50, and for visually indicating the rotational position of the collar 50. Collar 50 is preferably rotatably supported by or connected to support block 50. However, collar 50 could alternately be rotatably supported by or connected to housing 19 of spray device assembly 18.

It is to be understood that the present invention is not limited to the embodiment(s) described above and illustrated herein, but encompasses any and all variations falling within the scope of the appended claims. For example, references to the present invention herein are not intended to limit the scope of any claim or claim term, but instead merely make reference to one or more features that may be covered by one or more of the claims. Materials, processes and numerical examples described above are exemplary only, and should not be deemed to limit the claims. A single protrusion can be used instead of two protrusions 52/54 to selectively pinch tubes 42/44. In the case of a single protrusion, or in the case with the proper spacing between protrusions 52/54, the user could rotate the collar to an intermediate rotation position (between the first and second rotation positions), where neither supply tube 42/44 is pinched, and thus both nozzles 46/48 can be operated simultaneously to provide two streams at the same time. Lastly, while two nozzles, two supply lines and two rotational positions are shown and described above, it is within the scope of the present invention to include three or more nozzles, supply lines and collar rotational positions.

What is claimed is:

1. A cleaning device, comprising:

a shaft having a proximal end and a distal end;

a cleaning element mounted at the distal end of the shaft;

a spray device mounted at or near the distal end of the shaft, wherein the spray device includes:

a reservoir for storing liquid, a pump in fluid communication with the reservoir, and a nozzle in fluid communication with the pump;

a handle assembly mounted at the proximal end of the shaft, wherein the handle assembly includes:

a lever rotatable about a pivot point, the lever having first and second engagement surfaces of different distances from the pivot point, and a knob having a cam surface and being rotatable between first and second positions;

a rod extending between the pump and the lever;

wherein the knob cam surface is engaged with the rod for aligning a first end of the rod to the first engagement surface with the knob in the first position and aligning the first end of the rod to the second engagement surface with the knob in the second position; and wherein rotation of the lever causes the rod to longitudinally move toward the pump.

2. The cleaning device of claim 1, wherein each of the first and second engagement surfaces are concave surfaces.

3. The cleaning device of claim 1, wherein the rod is slidably mounted inside the shaft.

4. The cleaning device of claim 1, wherein the pump is configured to draw liquid from the reservoir and discharge the liquid to the nozzle in response to the longitudinal movement of the rod.

5. The cleaning device of claim 4, wherein an amount of the liquid drawn and discharged by the pump is a function of an amount of the longitudinal movement of the rod.

6. The cleaning device of claim 1, wherein the pump is configured to continually discharge the liquid to the nozzle in response to the longitudinal movement of the rod.

7. A cleaning device, comprising:

a shaft having a proximal end and a distal end;

a cleaning element mounted at the distal end of the shaft;

a spray device mounted at or near the distal end of the shaft, wherein the spray device includes:

a reservoir for storing liquid, a pump in fluid communication with the reservoir, and a nozzle in fluid communication with the pump;

a handle assembly mounted at the proximal end of the shaft, wherein the handle assembly includes:

a lever rotatable about a pivot point, the lever having first and second engagement surfaces of different distances from the pivot point, and a knob having a cam surface and being rotatable between first and second positions; and a rod having a first end terminating at the pump and a second end terminating at the lever;

wherein the knob cam surface is engaged with a side surface of the rod for translating the rod second end for engagement with the first engagement surface with the knob in the first position and for engagement with the second engagement surface with the knob in the second position;

wherein rotation of the lever causes the rod to longitudinally move toward and activate the pump.

8. The cleaning device of claim 7, wherein each of the first and second engagement surfaces are concave surfaces.

9. The cleaning device of claim 7, wherein the rod is slidably mounted inside the shaft.

10. The cleaning device of claim 7, wherein the pump is configured to draw liquid from the reservoir and discharge the liquid to the nozzle in response to the longitudinal movement of the rod.

11. The cleaning device of claim 10, wherein an amount of the liquid drawn and discharged by the pump is a function of an amount of the longitudinal movement of the rod.

12. The cleaning device of claim 7, wherein the pump is configured to continually discharge the liquid to the nozzle in response to the longitudinal movement of the rod.

* * * * *